US005143394A

United States Patent [19]

Piana

[11] Patent Number: 5,143,394

[45] Date of Patent: Sep. 1, 1992

[54] SKI PROVIDED WITH A VIBRATION DAMPING DEVICE

[75] Inventor: Angelo Piana, Casalborgone, Italy

[73] Assignee: Tua Ski S.r.l., Occhieppo Superiore, Italy

[21] Appl. No.: 615,064

[22] Filed: Nov. 19, 1990

[30] Foreign Application Priority Data

Nov. 24, 1989 [IT] Italy ..... 68039 A/89

[51] Int. Cl.[5] ..... A63C 5/07

[52] U.S. Cl. ..... 280/602; 188/379; 267/140.4; 280/601

[58] Field of Search ..... 280/602, 601; 267/140.1 R, 140.1 C, 140.4; 188/379, 268

[56] References Cited

U.S. PATENT DOCUMENTS

| | | | |
|---|---|---|---|
| 4,180,275 | 12/1979 | Montoya | 280/601 |
| 4,674,763 | 6/1987 | Schlagenhaufer | 280/602 |
| 4,865,345 | 9/1989 | Piegay | 280/602 |

FOREIGN PATENT DOCUMENTS

| | | | |
|---|---|---|---|
| 168579 | 1/1986 | European Pat. Off. | 280/602 |
| 337581 | 7/1977 | Fed. Rep. of Germany . | |
| 2645167 | 4/1978 | Fed. Rep. of Germany . | |
| 2701181 | 7/1978 | Fed. Rep. of Germany | 188/268 |
| 2747084 | 4/1979 | Fed. Rep. of Germany | 280/602 |
| 3717629 | 12/1988 | Fed. Rep. of Germany | 280/602 |
| 2616340 | 12/1988 | France | 280/602 |
| 562617 | 3/1972 | Switzerland | 280/601 |
| 558185 | 2/1973 | Switzerland | 280/601 |

*Primary Examiner*—Eric D. Culbreth
*Attorney, Agent, or Firm*—Klauber & Jackson

[57] ABSTRACT

A ski is provided with a device for damping vibrations which arise in use in the ski by the effect of impacts between the asperities of icy snow and the tip and tail of the ski itself. The device consists of at least one concentrated mass which is floatingly carried by at least one end of the ski in such a way as to be free to move in the vicinity of this end.

10 Claims, 3 Drawing Sheets

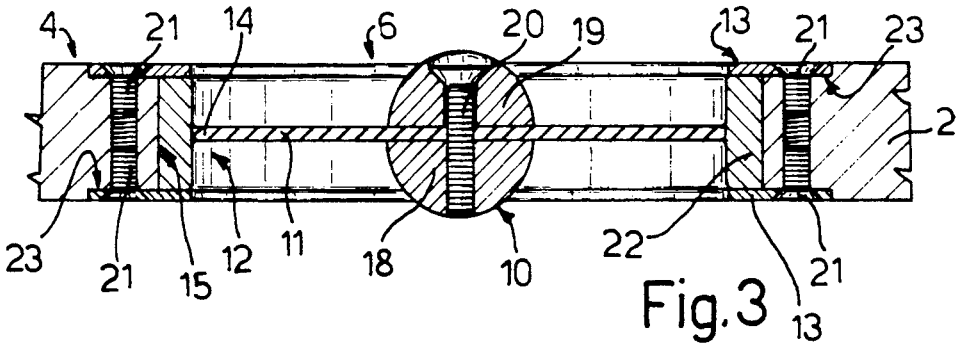
Fig.3
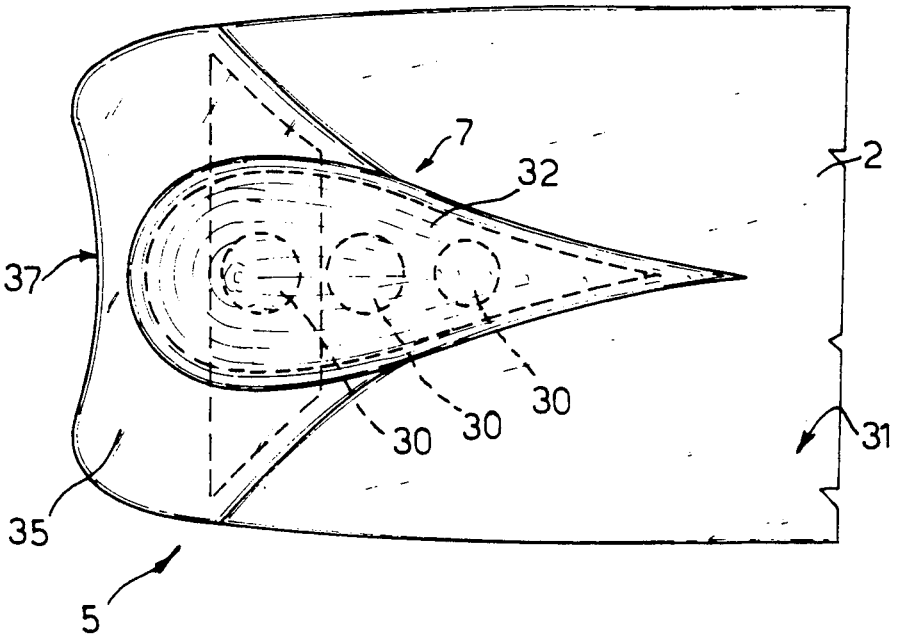
Fig.4
Fig. 5
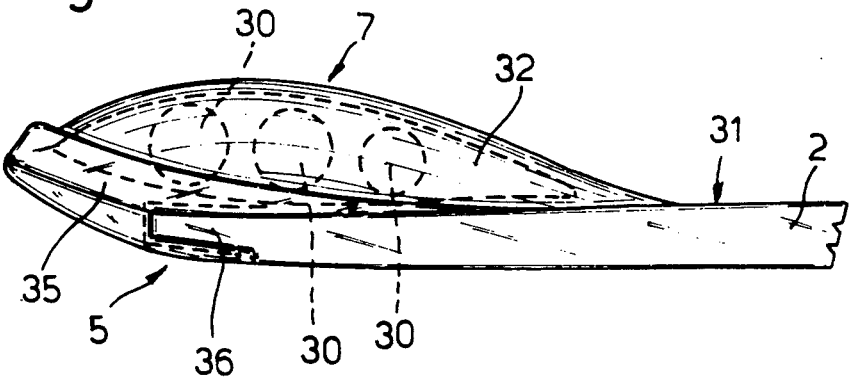

SKI PROVIDED WITH A VIBRATION DAMPING DEVICE

BACKGROUND OF THE INVENTION

The present invention relates to a ski of the type provided with a device for damping vibrations which are produced in the ski itself, for example by the effect of the impact between the asperities in the snow and the tip and tail of the ski.

It is known that, in particular during use on icy snow, vibrations in the ski can be triggered off which strongly reduce stability and which make it difficult for the user to control the ski: these vibrations, which, for example, can be triggered by incidental impacts between the tip and tail of the ski and the asperities in the snow in fact reduce the capacity of the edges of the ski to grip the snow, which capacity is already critical in the presence of ice. Vibrations of the said type are triggered more easily (and take a longer time to be damped) the longer and more flexible is the ski so that the problem of loss of control of the ski on the snow because of vibration of the ski itself is particularly serious in the case of alpine skis where, on the other hand, the maximum stability possible would be necessary given the almost exclusive off-track use to which this type of ski is put. The term off-track as used herein refers to skiing along a path or course that is not well travelled and therefore has many asperities, that is, which is very rough and bumpy.

Attempts have therefore been made to make available devices able, if not to eliminate (because this is substantially impossible) at least to damp as rapidly as possible the incidental vibrations which start up in the ski during skiing. One known device consists, for example, of weights mounted fixedly on the tip and tail of the ski. This device has been found, however, to be substantially ineffective if not downright dangerous in that, in all cases, the increase in weight on the tips of the ski retards the damping of the vibration.

SUMMARY OF THE INVENTION

The object of the invention is that of providing a ski having a vibration damping device for damping the vibrations which arise in the ski itself, which will be effective and simple to produce.

The said object is achieved by the invention, which relates to a ski of the type provided with a device for damping vibrations which arise in the ski itself, the said device comprising at least one concentrated mass mounted on at least a respective end of the ski, characterised by the fact that the said concentrated mass is floatingly carried by the said end of the ski, in such a way as to be free to move with respect to the ski in the immediate vicinity of the said end.

BRIEF DESCRIPTION OF THE DRAWINGS

For a better understanding of the invention there is now given a non-limitative description of some embodiments thereof, with reference to the attached drawings, in which:

FIG. 3 is a section taken on the line III—III of FIG. 2:

FIG. 4 is a plan view from above, on an enlarged scale, of the tail of the ski of FIG. 1:

FIG. 5 is a side elevation of the detail of FIG. 4:

DETAILED DESCRIPTION OF THE INVENTION

Figure 1:
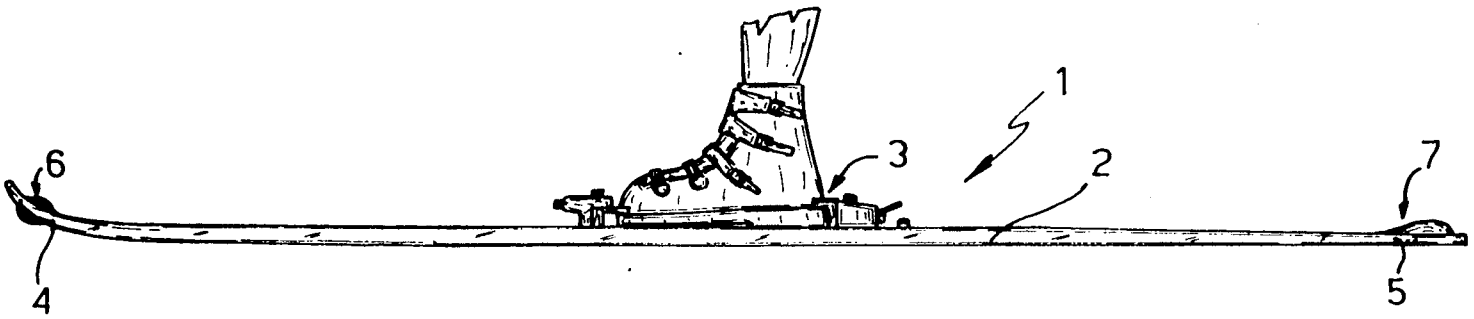
FIG. 1 is a side elevation of a ski formed according to the invention, fitted to the foot of a user.
Figure 2:
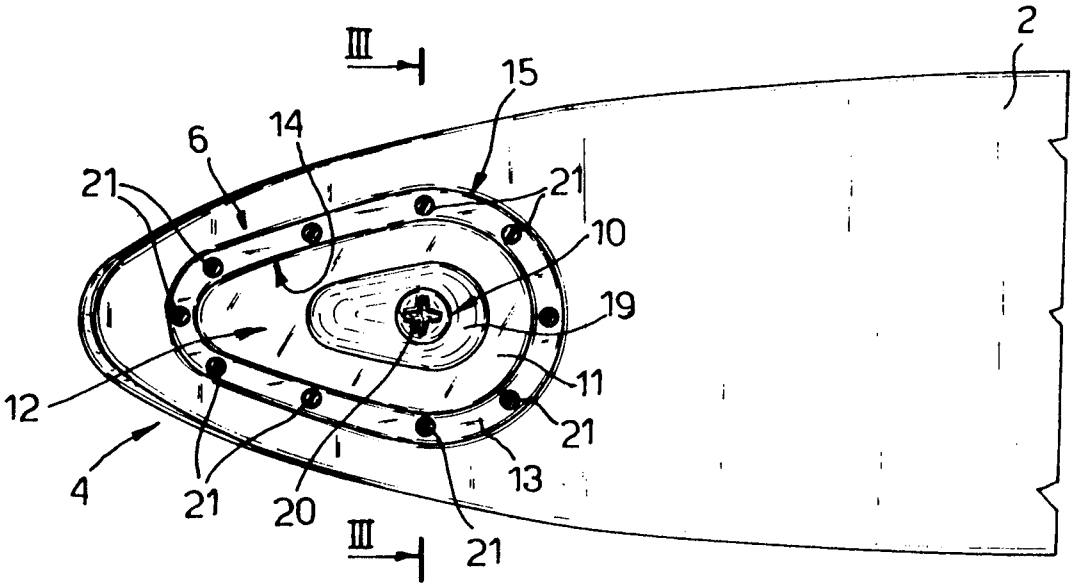
FIG. 2 is a plan view from above, on an enlarged scale, of the tip of the ski of FIG. 1.

With reference to FIGS. 1 to 5, the reference 1 indicates a ski of any known type (in the specific example illustrated this is a downhill ski, but the ski 1 according to the invention can equally well also be a cross country ski or an alpine ski). The ski 1 comprises a body 2 provided with attachments 3 and terminating with a tapered and upwardly curved front end or tip 4, and with an opposite rear end or square cut tail 5. In the non-limitative example illustrated, both the ends 4 and 5 are provided with respective vibration damping devices 6, 7 for damping vibrations which, in use, can arise in the ski 1, for example because of incidental impacts of the tip 4 and/or of the tail 5 against the asperities in the terrain and, in particular, in the icy snow cover during skiing, in particular off-track. In the most general embodiment of the invention it is sufficient that the ski 1 include a single damping device, in correspondence with a single end, preferably the front end or tip 4, but to obtain the maximum vibration damping effect it is obvious that since these can be triggered both at the tip 4 and at the tail 5, it is suitable that both ends of the ski be provided with damping devices.

According to the invention the devices 6, 7 essentially comprise at least one concentrated mass and means for stably fixing this mass to the tip or to the tail of the ski in a floating manner, or rather in such a manner that the said concentrated mass is free to move with respect to the ski 1 in the immediate vicinity of the respective end 4, 5 to which it is secured. The term "concentrated mass" is intended to mean here and hereinafter in the description, any type of element having a specific mass relatively higher than that of the material with which the body 2 of the ski is constructed, and of a form such that the total resulting mass of the element is concentrated in proximity to its centre of gravity.

In the specific example illustrated, the device 6 comprises a metal olive element 10, a resiliently deformable membrane 11 made of an elastomeric material, for example in rubber, which membrane carries the olive-element 10 fixedly secured substantially at its centre, a cavity 12 passing through the body 2 i the region of the tip 4, and an anchoring flange 13 which securely connects a peripheral outer edge 14 of the membrane 11 to a perimetral rim 15 of the cavity 12 in such a way that the olive element 10 is floatingly lodged (by way of the deformability of the membrane 11 which supports it) to the interior of the cavity 12 and so that this latter is closed by the membrane 11 in such a way as to prevent snow from passing through the tip 4. The cavity 12 is formed substantially coplanar with the tip 4, in fact following the curvature, and the membrane 11 is disposed in the transverse median plane of the cavity 12.

The olive element 10 comprises, in the specific example, two parts or hemispheres 18, 19 disposed lying on opposite faces of the membrane 11 and mutually joined to one another through the membrane 11, for example by means of a screw 20 passing therethrough in such a way that the membrane 11 is clamped between the elements 18, 19, which are connected to the body 2 exclusively by the membrane. The membrane 11, in turn, can be fixed to the body 2 simply by clamping its peripheral edge 14 between the rim 15 of the cavity 12 and the flange 13, which is fixed in turn to the body 2 by means of a plurality of screws 21, or, as in the specific example illustrated, can be directly vulcanised to a ring 22 (FIG. 3) which is fixed between a pair of flanges 13 each fixed to the body 2 flush with an opposite surface thereof, housed in a respective rebate 23, or, alternatively, in another variant not illustrated, can be directly glued to the body 2 thus eliminating the necessity for the flange 13.

Figure 6:
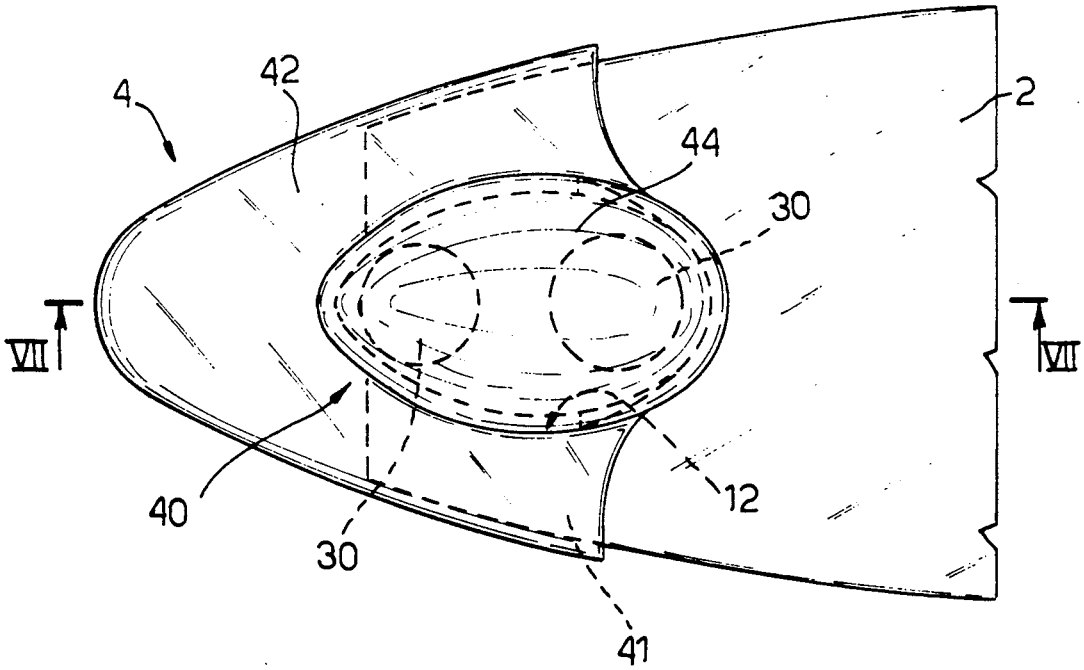
FIG. 6 is a plan view from above, on an enlarged scale, of the tip of the ski formed according to a possible variant of the invention.

As illustrated the device 7 at the tail comprises a plurality of balls 30 (in the specific example three and, preferably at least two in number), which are freely housed with play within the interior of a container 32 carried fixedly by the rear end 5 of ski 1, on an upper face 31 of the ski itself. In the specific example illustrated the container 32 is shaped as a droplet, with the thinnest par facing the tip 4 of the ski 1 and forms part of a rear block 35 curved upwardly and fitted onto the tail 5 coupled so as to project from a stepped rear edge 36 of the tail itself and from which the container 32 extends forwardly, projecting towards the tip 4. The block 35 preferably has a concave rear edge 37 and is adapted to function as a fixing element (in the event that ski 1 is an alpine ski) for a seal skin, not illustrated for simplicity. As illustrated in the possible variant of FIGS. 6 and 7, the previously described front device 6 can be replaced by a device 40 similar to the device 7. The similar or identical details to those already described are indicated for simplicity with the same reference numerals. In particular, in this variant, the tip 4 of the ski 1 is formed by a front end 41 of the body 2, which is cut square and is provided with a forwardly open cavity 12 passing therethrough, and by a cap 42, for example made of moulded synthetic plastics resin, fitted fixedly to the front end 41 in such a way as to define with it the tip 4 of the ski. The cap 42 comprises a container 44 with an olive-shape formed integrally therewith. The container 4 projects rearwardly from the cap 42 towards the tail 5, and is fixedly housed to the interior of the cavity 12 which is formed substantially coplanar with the assembly of elements forming the tip 4. Within the container 44 are freely housed, with clearance, two balls 30 which are therefore free to move within the interior of the cavity 12, which is occupied by the container 44 which houses them.

Figure 7:
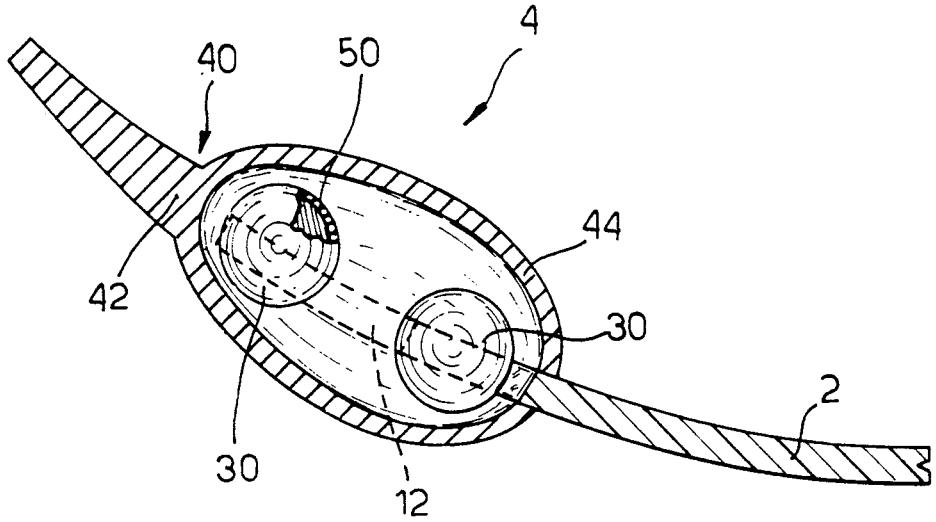
FIG. 7 is a section taken on the line IV—IV of the tip of the ski illustrated in FIG. 6.

For the purpose of preventing the balls 30 from striking noisily against one another and against the inner walls of the containers 32, 34, as well as to improve the damping effect, the balls 30, which are preferably made of metal and which are preferably constituted by balls of the type used for rolling element bearings, are clad both in the case of the device 7 and in the case of the device 40, by a surface layer 50 of elastomeric material (FIG. 7).

The operation of the ski according to the invention is as follows. During skiing the impacts of the tip 4 and the tail 5 on the asperities of the snow covering trigger off vibrations in the ski 1, in particular in the body 2 which, as is known, is made with a highly-resilient and flexible structure: these impacts, as well as the vibrations triggered thereby, also cause displacement of the suspended masses constituted by the balls 30 and/or by the olive-shape element 10. In particular, the element 10 will commence displacement within the cavity 12 giving rise to a complex vibration in the membrane 11 and transmitting inertial stresses through it to the body 2. The balls 30 will begin to roll within the containers 32, 40, striking against one another and against the walls thereof, therefore applying inertial stresses to the containers 32, 34 which transmit them in turn to the body 2 to which they are fixedly secured. In both cases, the specific mass of the oscillating elements 10, 30 being different from that of the body 2, and above all the distribution of these masses being different (the masses of the elements 10, 30 can be considered approximately concentrated entirely at the centre of gravity thereof), whilst the mass of the body 2 is distributed over the whole of the length of the ski 1, body 2 and element 10, 30 enter into vibrations having different harmonics which, according to experimental tests conducted by the applicants, are surprisingly found to be predominantly in phase opposition so that a high number of cancellations is obtained, with consequent rapid damping of the vibrations themselves. In substance the vibrations which arise in the masses 10, 30 rapidly nullify those arising in the body 2.

Experimental tests conducted by the applicants have demonstrated that the vibrations triggered, in the same conditions and on the same ski, are cancelled in the case of the presence of the devices 6, 7, 40 in a time which is even forty times less than that necessary in the absence of these devices. It has moreover been demonstrated that the devices 7, 40 having free balls, are more effective than the device 6 having the resiliently suspended mass, and this is in accordance with the previously described hypothesis of function, whilst in fact the device 6 has a typical resonance frequency, which can even be calculated depending exclusively on the mass of the element 10, from the elastic constant of the membrane 11, and from the damping constant thereof (or rather whilst the device 6 behaves as a typical damped vibrating system of the second order), in the case of the devices 7 and 40 the impacts between the balls 30, which are casual, create the superimposition of a plurality of harmonics so that the damping takes place very much more rapidly.

From what has been described the advantages connected with the invention are evident. With the simple adoption of extremely simple, economic devices which are easy to install and which do not alter in any way the normal functionality of the ski, rapid damping of the vibrations to which the ski is subject in use is achieved. This translates into an improved grip of the edges of the ski on the snow cover, in particular when this is icy, which converts into a improved controllability and stability of the ski and into a greater comfort for the user. It is also clear that this damping effect can be obtained utilising the described devices 6, 7, 40 on their own or in any combination. It is, finally, clear that in the devices 7. 40 it is also possible to utilise a single ball 30. In this case, however, the effectiveness of the device will be slightly reduced and equivalent to that of the device 6, in that the further damping effect due to the casual impacts between the balls 30 themselves is lost.

I claim:

1. A ski comprising a body having opposite ends and a device for damping vibrations which arise in the ski itself, said device comprising at least one concentrated mass suspended to at least one end of said body of said ski so as to be able, in response to vibrations of said body, to enter into vibrations, said at least one concentrated mass being floatingly carried by a front end of the ski, in the vicinity of an upwardly curved tip thereof, said vibration damping device including a concentrated mass defined by a metal olive shaped element, a resiliently deformable membrane formed of elastomeric material and carrying said olive shaped element fixedly secured substantially at its center, a cavity passing through said front end of the ski, and means for fixedly securing an outer peripheral edge of said membrane to a perimetral rim of said cavity in such a way that said olive shaped element is housed within the cavity and the cavity is closed by said membrane.

2. A ski according to claim 1, wherein said olive shaped element comprises two pieces disposed on opposite faces of the membrane and mutually joined to one another by means of a screw passing therethrough, in such a way that the membrane is clamped between the two pieces.

3. A ski comprising a body having opposite ends and a device for damping vibrations which arise in the ski itself, said device comprising an extremely small number of concentrated masses freely movable in a liquidless cavity at at least one end of said body of said ski so as to be able, in response to vibrations of said body, to enter into vibrations, by colliding against each other and against walls which define the cavity, so as to damp said vibrations which arise in the ski itself.

4. A ski according to claim 3, further including a container carried fixedly by a rear end of the ski on an upper face of the ski itself, and an extremely small number of balls freely housed within the interior of the container.

5. A ski according to claim 3, wherein said concentrated masses are freely movable in said cavity, said cavity being a front end of the ski, in the vicinity of an upwardly curved tip thereof.

6. A ski according to claim 5, wherein said concentrated masses are disposed in a cavity formed substantially coplanar with said tip.

7. A ski according to claim 5, wherein said concentrated masses comprise balls which are freely housed with clearance within the interior of said cavity fixedly secured to said front end of the ski.

8. A ski according to claim 7, wherein said balls are clad in a layer of elastomeric material.

9. A ski according to claim 7, wherein said container is fixedly housed to the interior of a cavity passing through said front end.

10. A ski according to claim 9, wherein said container is formed integrally with a shaped cap made of synthetic plastics material and fitted on said front end to define said tip of the ski.

* * * * *

UNITED STATES PATENT AND TRADEMARK OFFICE

CERTIFICATE OF CORRECTION

PATENT NO. : 5,143,394

DATED : SEPTEMBER 1,1992

INVENTOR(S) : ANGELO PIANA

It is certified that error appears in the above-indentified patent and that said Letters Patent is hereby corrected as shown below:

ON THE TITLE PAGE ITEM [73]

-- TUA SKI S.r.l., OCCHIEPPO SUPERIORE, ITALY, BY MESNE ASSIGNMENT OF 50% INTEREST FROM SAID ANGELO PIANA --.

Signed and Sealed this

Twenty-ninth Day of November, 1994

*Attest:*

Bruce Lehman

BRUCE LEHMAN

*Attesting Officer*

*Commissioner of Patents and Trademarks*